US011503867B2

(12) United States Patent
Pérez Rodriguez

(10) Patent No.: US 11,503,867 B2
(45) Date of Patent: Nov. 22, 2022

(54) PANTS CONVERTIBLE TO SKIRT, AND VICE VERSA

(71) Applicant: Yeray Pérez Rodriguez, Tenerife (ES)

(72) Inventor: Yeray Pérez Rodriguez, Tenerife (ES)

( * ) Notice: Subject to any disclaimer, the term of this patent is extended or adjusted under 35 U.S.C. 154(b) by 0 days.

(21) Appl. No.: 16/925,819

(22) Filed: Jul. 10, 2020

(65) Prior Publication Data

US 2020/0337395 A1 Oct. 29, 2020

Related U.S. Application Data

(63) Continuation-in-part of application No. PCT/ES2019/000003, filed on Jan. 11, 2019.

(30) Foreign Application Priority Data

Jan. 13, 2018 (ES) ..... ES201830044U

(51) Int. Cl.
*A41D 15/02* (2006.01)

(52) U.S. Cl.
CPC ..... *A41D 15/02* (2013.01)

(58) Field of Classification Search
CPC ..... A41D 15/02; A41D 15/04; A41D 15/00; A41D 15/002; A41D 3/06
See application file for complete search history.

(56) References Cited

U.S. PATENT DOCUMENTS 265,043 A * 9/1882 Emanuel ..... A41D 3/06 2/86
1,031,719 A * 7/1912 Kurz et al. ..... A41D 3/06 2/86
1,470,849 A * 10/1923 Klappert ..... A41D 15/02 2/72

(Continued)

FOREIGN PATENT DOCUMENTS

CA 2690810 A1 * 12/2008 ..... A41D 1/08
CN 204742660 U 11/2015

(Continued)

OTHER PUBLICATIONS

International Search Report and Written Opinion for International Application No. PCT/ES2019/000003 dated Jul. 18, 2019.

(Continued)

*Primary Examiner* — Alissa L Hoey
(74) *Attorney, Agent, or Firm* — Perilla Knox & Hildebrandt LLP; Kenneth A. Knox

(57) ABSTRACT

A garment convertible between a pair of pants and a skirt is described. The garment comprises a waist region; a pants region positioned below the waist region, the pants region comprising a first pant leg and a second pant leg; a plurality of loops coupled to the waist region, individual ones of the plurality of loops comprising a loop fastener positioned thereon; and a plurality of pant leg fasteners positioned in the pants region on at least one of the first pant leg and the second pant leg, wherein, when the loop fastener of the plurality of loops are coupled to a respective one of the pant leg fasteners, the garment is operable to be worn as a skirt and, when the loop fastener of the plurality of loops is detached from the respective one of the pant leg fasteners, the garment is operable to be worn as a pair of pants.

14 Claims, 6 Drawing Sheets

(56) References Cited

U.S. PATENT DOCUMENTS 1,664,309 A * 3/1928 Mueller ..... A41D 3/06 2/86
1,772,298 A * 8/1930 Werber ..... A41D 3/06 2/86
1,783,505 A * 12/1930 Hayes ..... A41D 3/06 2/86
1,783,572 A * 12/1930 Minnie ..... A41D 10/00 2/72
1,825,197 A * 9/1931 Mcginnis ..... A41D 3/06 2/86
2,048,120 A * 7/1936 Greenbaum ..... A41D 15/002 2/212
2,073,485 A * 3/1937 Knowling ..... A41D 3/06 2/86
2,236,636 A * 4/1941 Louise ..... A41D 27/28 2/227
2,343,480 A * 3/1944 Sansom ..... A41D 15/02 2/213
2,368,189 A * 1/1945 Wolman ..... A41D 15/02 2/213
2,659,086 A * 11/1953 Mcgrath ..... A41D 3/00 2/88
2,959,788 A * 11/1960 Rosella ..... A41D 3/06 2/86
3,311,924 A * 4/1967 Roark ..... A41D 3/06 2/87
3,473,169 A * 10/1969 Tiedeman ..... A41D 15/02 2/213
4,104,742 A * 8/1978 Rahaim ..... A41D 15/02 2/213
4,106,125 A * 8/1978 Palumbo ..... A41D 15/02 2/213
4,683,595 A * 8/1987 Cash ..... A41D 15/00 2/221
4,718,122 A * 1/1988 Steverson ..... A41D 15/02 2/70
4,907,298 A * 3/1990 Lisowski ..... A41D 15/02 2/212
5,611,082 A * 3/1997 Bull ..... A41D 13/00 2/79
6,105,169 A * 8/2000 Colorado ..... A62B 35/0025 182/6
6,260,209 B1 * 7/2001 St. Ange ..... A41D 1/08 2/227
6,336,226 B1 * 1/2002 Garcia ..... A41D 15/04 2/227
7,966,672 B1 * 6/2011 Hagerman ..... A41D 13/02 2/227
8,032,951 B1 * 10/2011 Nestberg ..... A41D 13/0012 2/247
8,104,099 B2 * 1/2012 Olmos Plaza ..... A41D 15/02 2/211
9,468,240 B2 * 10/2016 Lee ..... A41D 1/21
10,633,787 B1 * 4/2020 Pham ..... D06F 95/008
10,952,482 B2 * 3/2021 Plon ..... A42B 1/24
2002/0042942 A1 * 4/2002 Colorado ..... A41D 13/0007 2/230
2002/0069487 A1 * 6/2002 Mei ..... A45F 5/02 24/3.1
2003/0131401 A1 * 7/2003 Dilworth, Jr. ..... A41D 13/12 2/457
2006/0096002 A1 * 5/2006 Lin ..... A41D 3/06 2/87
2008/0034478 A1 * 2/2008 Patterson ..... A41B 11/002 2/239
2009/0070915 A1 * 3/2009 Hill ..... A41F 9/002 2/117
2009/0151052 A1 * 6/2009 Masutani ..... A41F 9/007 2/244
2010/0095422 A1 * 4/2010 Lopez ..... A41D 13/065 2/23
2010/0170026 A1 * 7/2010 Jeffords ..... A41D 27/08 2/227
2012/0204313 A1 * 8/2012 Evans ..... A41F 5/00 2/70
2015/0327605 A1 * 11/2015 Tippett ..... A41D 1/14 2/212
2016/0206022 A1 * 7/2016 Kroecher ..... A41D 1/06
2016/0338430 A1 * 11/2016 Faddoul ..... A41F 1/004
2017/0035123 A1 * 2/2017 Rodd ..... A41D 15/00
2017/0079345 A1 * 3/2017 Garner ..... A41D 27/08
2017/0135421 A1 * 5/2017 Treyger ..... A41D 27/10
2017/0251736 A1 * 9/2017 Harbert ..... A41D 15/04
2018/0055127 A1 * 3/2018 Plon ..... A42B 1/24
2018/0255853 A1 * 9/2018 Spathas ..... A41D 7/00
2019/0116899 A1 * 4/2019 Williams ..... A41D 1/02

FOREIGN PATENT DOCUMENTS

CN 106174810 A 12/2016
CN 107495493 A 12/2017
DE 102010011479 A1 * 9/2011 ..... A41D 15/02
ES 1205163 U 2/2018
FR 2904917 A1 * 2/2008 ..... A41D 15/002
WO WO-0040107 A1 * 7/2000 ..... A41D 15/02
WO WO-2013026112 A1 * 2/2013 ..... A41D 15/02

OTHER PUBLICATIONS

Archive.org, "Pantalon ajuste a detail noue kaki," https://web.archive.org/web/20170912030214/https://www.prettylittlething.fr/detta-pantalon-ajuste-a-detail-noue-kaki.html, Alleged Publication: Sep. 12, 2017 (downloaded: Jul. 9, 2020).
Archive.org, "Pantalones con bajos originales: fotos de los mejores modelos," https://web.archive.org/web/20171226043133/www.ellahoy.es/moda/fotos/pantalones-con-bajos-originales-fotos-de-los-mejores-modelos_22751.html, Alleged Publication: Dec. 26, 2017 (downloaded: Jul. 9, 2020).

* cited by examiner

PANTS CONVERTIBLE TO SKIRT, AND VICE VERSA

CROSS-REFERENCE TO RELATED APPLICATIONS

This application is a continuation-in-part of International Application No. PCT/ES2019/000003 filed Jan. 11, 2019 and entitled "ADAPTABLE TROUSERS," which claims the benefit of and priority to Spanish Patent Application No. 0201830044 filed Jan. 13, 2018, the contents of which being incorporated by reference in their entireties herein.

BACKGROUND

Pants, also referred to as trousers, include an article of worn from the waist to the ankles that cover both legs separately, rather than with cloth extending across both legs as seen in skirts and dresses.

FIELD OF THE INVENTION

The present disclosure relates to textiles and, more specifically, relates to the design and manufacturing of pants, skirts, and similar articles of clothing.

BRIEF SUMMARY OF THE INVENTION

Accordingly, a garment that is convertible between a pair of pants and a skirt is described, where the garment includes a waist region; a pants region positioned below the waist region, the pants region comprising a first pant leg and a second pant leg; a plurality of loops coupled to the waist region (e.g., a front of the waist of the garment), individual ones of the plurality of loops comprising a loop fastener positioned thereon; and a plurality of pant leg fasteners positioned in the pants region on at least one of the first pant leg and the second pant leg. When the loop fastener of the plurality of loops is coupled to a respective one of the pant leg fasteners of the pant region, the garment is operable to be worn as a skirt. When the loop fastener of the plurality of loops is detached from the respective one of the pant leg fasteners, the garment is operable to be worn as a pair of pants, as may be appreciated.

In some embodiments, the pant leg fasteners include a first plurality of pant leg fasteners positioned on the first pant leg, and a second plurality of pant leg fasteners positioned on the second pant leg. The first plurality of pant leg fasteners and the second plurality of pant leg fasteners positioned are positioned in a 2×3 matrix arrangement in some embodiments (for instance, two columns of connectors and three rows of connectors, or vice versa). In some embodiments, the plurality of loops are a plurality of belt loops extending upward from the waist region of the garment.

The garment may further include a piece of removable fabric and a connector, such as a zipper, configured to removably attach the piece of removable fabric to the garment. In some embodiments, the plurality of loop fasteners are female snap fasteners and the plurality of pant leg fasteners are male snap fasteners, or vice versa. In some embodiments, the plurality of pant leg fasteners are positioned in a shin region (e.g., where a shin of a wear would be located) of the first pant leg and the second pant le, respectively.

A method is further described that includes providing a garment convertible between a pair of pants and a skirt, where the garment includes a waist region; a pants region positioned below the waist region, the pants region comprising a first pant leg and a second pant leg; a plurality of loops coupled to the waist region, individual ones of the plurality of loops comprising a loop fastener positioned thereon; and a plurality of pant leg fasteners positioned in the pants region on at least one of the first pant leg and the second pant leg.

The method further includes coupling the loop fastener of the plurality of loops to a respective one of the pant leg fasteners and wearing the garment as a skirt; and detaching the loop fastener of the plurality of loops from the respective one of the pant leg fasteners and wearing the garment as a pair of pants.

Finally, a garment convertible between a pair of pants and a skirt, includes a waist region; a pants region positioned below the waist region, the pants region comprising a first pant leg and a second pant leg; a plurality of pieces of fabric coupled to the waist region, individual ones of the plurality of pieces of fabric comprising a fabric fastener positioned thereon; a plurality of pant leg fasteners positioned in the pants region on at least one of the first pant leg and the second pant leg, wherein, when the fabric fastener of the plurality of pieces of fabric are coupled to a respective one of the pant leg fasteners, the garment is operable to be worn as a skirt and, when the fabric fastener of the plurality of pieces of fabric is detached from the respective one of the pant leg fasteners, the garment is operable to be worn as a pair of pants. In some embodiments, the plurality of pieces of fabric are a plurality of belt loops.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Further characteristics, features, and benefits of the embodiments described herein will become evident after the clarification of the detailed illustration of figures.

DETAILED DESCRIPTION

The present disclosure relates to a garment that is convertible between a pair of pants and a skirt, and vice versa. Specifically, various embodiments described herein relate to a convertible garment or, more specifically, a convertible pant, which is intended to be worn in either a first state, as a pair of pants, or a second state, as a skirt. More specifically, various embodiments relate to a versatile pant having both a waist portion and an underside of the pant with attachment means, connection mechanism, etc., such that the two parts can be joined together. Thus, the versatile pant can be used as a skirt so that the wearer can wear the improved pant around the waist. The attachment means, connection mechanism, etc. employed may include snap fasteners, brackets, zipper, buttons, cords, or similar mechanisms.

Figure 1:
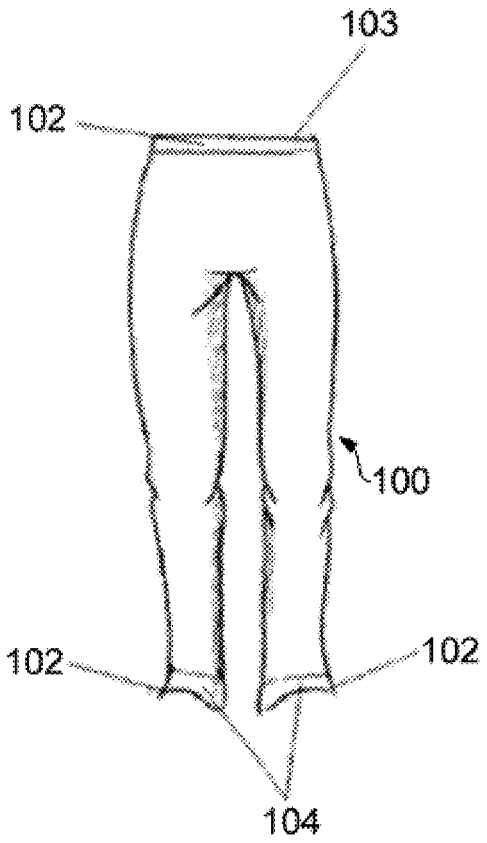
FIG. 1 is a front view of a pair of pants convertible to skirt, and vice versa, according to various embodiments of the present disclosure.
Figure 6:
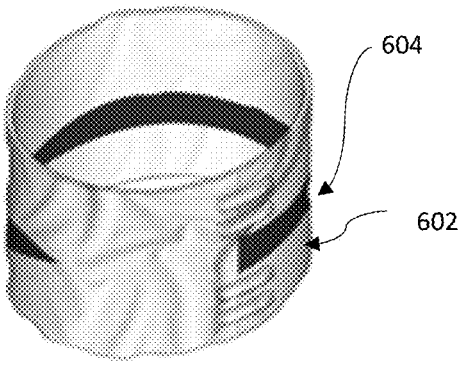
FIG. 6 is a rear view of a pair of pants convertible to skirt, and vice versa, worn as a skirt according to various embodiments of the present disclosure.

Turning now to the drawings, FIG. 1 is a front view of a garment 100 configured to be worn as pants and/or worn as a skirt, as shown in FIG. 6. As shown in FIG. 1, the garment 100 includes connection means 102 placed around a waist 103 of the garment 100 and at a bottom 104 of the garment 100, such that they both parts can be joined and the garment 100 may be used in a skirt mode. The connection means 102 employed may include brackets, zipper, buttons, cords and the like.

Referring now to FIGS. 2-6, various front views of a garment 100 is shown. The garment 100 includes a waist region 105 and a pant region 110 below the waist region 105. The pant region 110 may include a first pant leg 115*a* (e.g., a right pant leg) and a second pant leg 115*b* (e.g., a left pant leg) (collectively "pant legs 115"). In an upper portion of the garment 100 (for instance, in one upper part of a waist area of the pants or other garment), there may be a plurality of loops 120*a*, 120*b*, 120*c*, 120*n* (or a plurality of pieces of fabric) comprising a plurality of loop fasteners 125*c*, 125*n* positioned thereon. In some embodiments, the loops 120 include belt loops having an opening through which a belt, rope, or other accessory may be position therethrough. In some embodiments, the loops 120 may extend upward from the waist region 105 and/or the garment 100.

Figure 2:
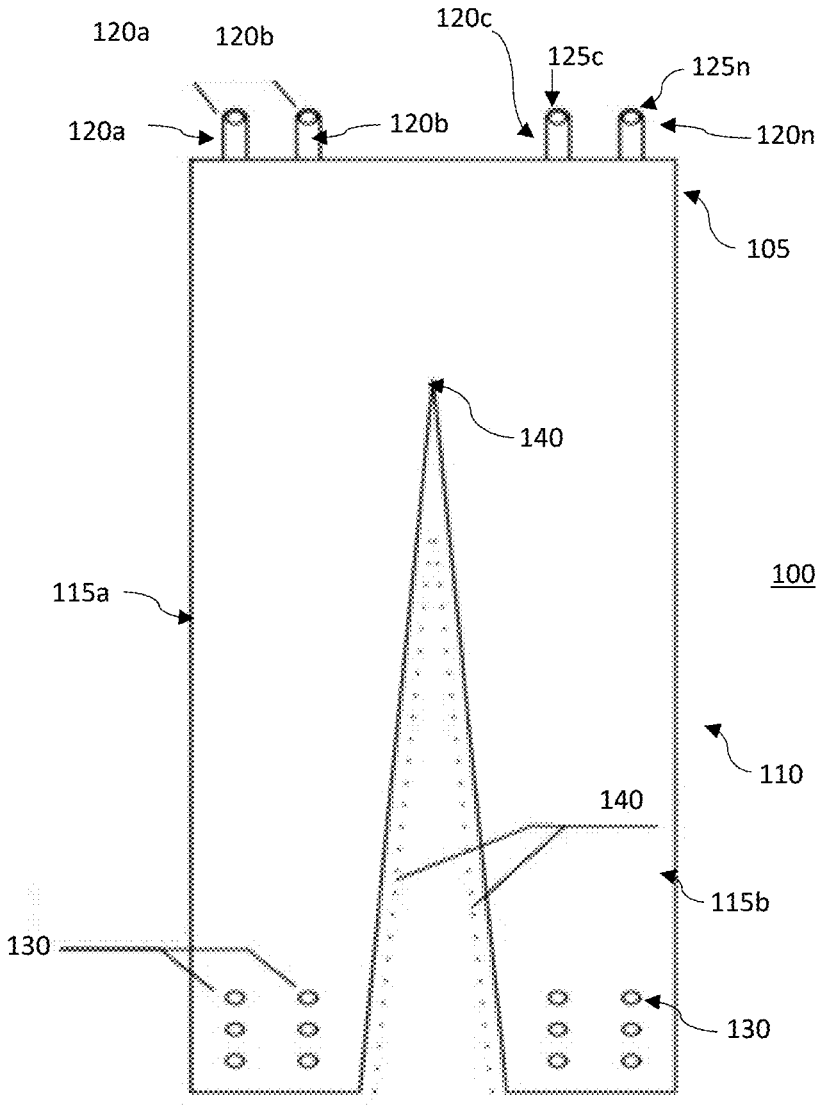
FIG. 2-5 are various views of a pair of pants convertible to skirt, and vice versa, according to various embodiments of the present disclosure.
Figure 3:
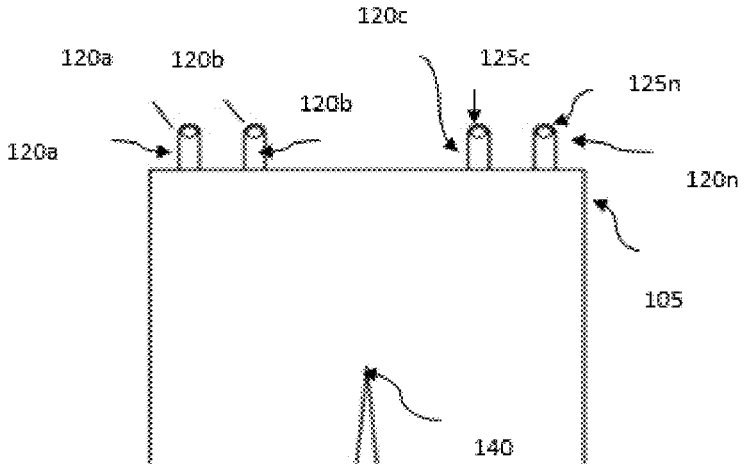
Figure 4:
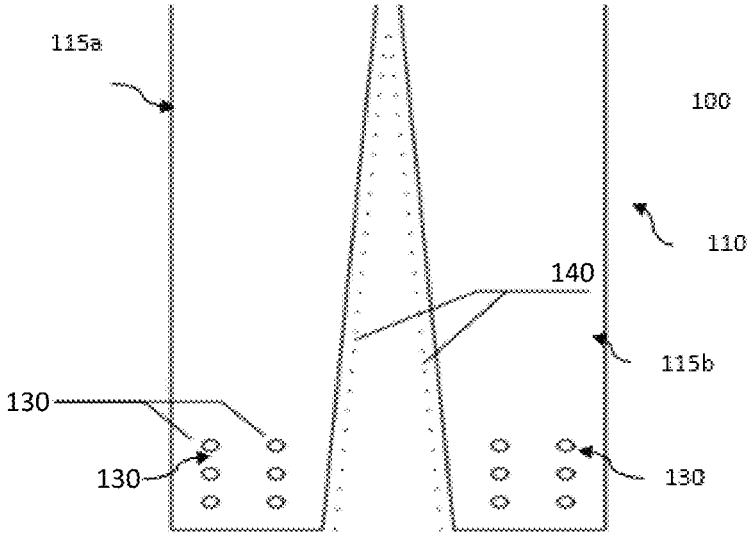
Figure 5:
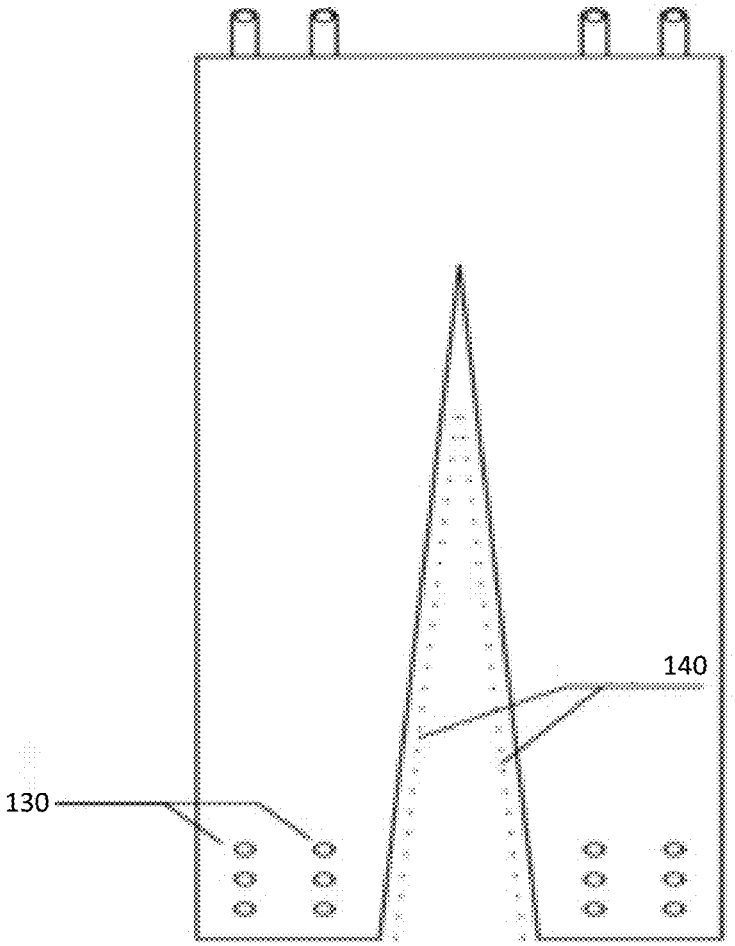

In the embodiment of FIG. 2, four loops 120 are shown although another number of loops 120 may be employed. In some embodiments, the loop fasteners 125 includes female snap fasteners, which are configured to detachably connect to corresponding pant leg fasteners 130 (e.g., male snap fasteners or other suitable connectors) located on pant legs or other lower portion of the garment 100. As shown in FIG. 2, each pant leg 115 may include a 2×3 matrix of pant leg fasteners 130 (e.g., each pant leg 115 having six fasteners 130), where each row and column is positioned in a unique position on the pant leg 115. The pant leg fasteners 130 in some embodiments may include male press studs, other male fasteners, or other suitable connectors located at varying distances from the loops 120. While the pant leg fasteners 130 are described herein as male fasteners, and the loop fasteners 125 as female fasteners, in other embodiments, the loop fasteners 125 may include male fasteners and the pant leg fasteners 130 may include female fasteners. The male and/or female fasteners may include snap fasteners, as may be appreciated, or may include hook-and-loop fasteners (e.g., VELCRO), buttons, or other suitable fastener. As such, a person or operator in charge of putting the garment 100 on is able to adjust it as it best fits around the waist.

In various embodiments, in a central portion between the two pants legs 115, an additional piece of removable fabric with a zipper 140 or other connection mechanism is provided to cover a hole.

Accordingly, a garment 100 that is convertible between a pair of pants and a skirt is described, where the garment 100 includes a waist region 105; a pants region 110 positioned below the waist region 105, the pants region 110 comprising a first pant leg 115*a* and a second pant leg 115*b;* a plurality of loops 120 coupled to the waist region 105 (e.g., a front of the waist of the garment 100), individual ones of the plurality of loops 120 comprising a loop fastener 125 positioned thereon; and a plurality of pant leg fasteners 130 positioned in the pants region 110 on at least one of the first pant leg 115*a* and the second pant leg 115*b*. When the loop fastener 125 of the plurality of loops 120 is coupled to a respective one of the pant leg fasteners 130 of the pant region 110, the garment 100 is operable to be worn as a skirt. When the loop fastener 125 of the plurality of loops 120 is detached from the respective one of the pant leg fasteners 130, the garment 100 is operable to be worn as a pair of pants, as may be appreciated.

In some embodiments, the pant leg fasteners 130 include a first plurality of pant leg fasteners 130*a* positioned on the first pant leg 115*a,* and a second plurality of pant leg fasteners 130*b* positioned on the second pant leg 115*b*. The first plurality of pant leg fasteners 130*a* and the second plurality of pant leg fasteners 130*b* positioned are positioned in a 2×3 matrix arrangement in some embodiments (for instance, two columns of connectors and three rows of connectors, or vice versa). In some embodiments, the plurality of loops 120 are a plurality of belt loops 120 extending upward from the waist region 105 of the garment 100.

The garment 100 may further include a piece of removable fabric and a connector, such as a zipper 140, configured to removably attach the piece of removable fabric 604 to the pant legs 602. In some embodiments, the plurality of loop fasteners 125 are female snap fasteners and the plurality of pant leg fasteners 130 are male snap fasteners, or vice versa. In some embodiments, the plurality of pant leg fasteners 130 are positioned in a shin region (e.g., where a shin of a wear would be located) of the first pant leg 115*a* and the second pant leg 115*b*, respectively.

A method is further described that includes providing a garment 100 convertible between a pair of pants and a skirt, where the garment 100 includes a waist region 105; a pants region 110 positioned below the waist region 105, the pants region 110 comprising a first pant leg 115*a* and a second pant leg 115*b;* a plurality of loops 120 coupled to the waist region 105, individual ones of the plurality of loops 120 comprising a loop fastener 125 positioned thereon; and a plurality of pant leg fasteners 130 positioned in the pants region 110 on at least one of the first pant leg 115*a* and the second pant leg 115*b*.

The method further includes coupling the loop fastener 125 of the plurality of loops 120 to a respective one of the pant leg fasteners 130 and wearing the garment 100 as a skirt; and detaching the loop fastener 125 of the plurality of loops 120 from the respective one of the pant leg fasteners 130 and wearing the garment 100 as a pair of pants.

Finally, a garment 100 convertible between a pair of pants and a skirt, includes a waist region 105; a pants region 110 positioned below the waist region 105, the pants region 110 comprising a first pant leg 115*a* and a second pant leg 115*b;* a plurality of pieces of fabric 120 coupled to the waist region 105, individual ones of the plurality of pieces of fabric 120 comprising a fabric fastener 125 positioned thereon; a plurality of pant leg fasteners 130 positioned in the pants region 110 on at least one of the first pant leg 115*a* and the second pant leg 115*b,* wherein, when the fabric fastener 125 of the plurality of pieces of fabric 120 are coupled to a respective one of the pant leg fasteners 130, the garment 100 is operable to be worn as a skirt and, when the fabric fastener 125 of the plurality of pieces of fabric 120 is detached from the respective one of the pant leg fasteners 130, the garment 100 is operable to be worn as a pair of pants. In some embodiments, the plurality of pieces of fabric are a plurality of belt loops 120.

Accordingly, the present disclosure relates to a versatile and convertible garment, as well as the method of manufacture and method of use. It is not considered necessary to make an extensive explanation for any person skilled in the art to understand its scope and the advantages thereof are derived. Furthermore, it being understood that, within its essence, it may be practiced in other embodiments which differ in detail from that given by way of example, and which will also reach the protection that is desired so long as it does not alter, change, or modify its fundamental principle.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A garment convertible between a pair of pants and a skirt, comprising:

a waist region;

a pants region positioned below the waist region, the pants region comprising a first tubular pant leg and a second tubular pant leg, the first tubular pant leg and the second tubular pant leg each forming a closed tube with openings at an upper end and a lower end;

a plurality of pant leg fasteners positioned in the pants region at a bottom end of the garment on each of the first tubular pant leg and the second tubular pant leg;

a plurality of loops positioned on the waist region at a top end of the garment, individual ones of the plurality of loops comprising a first fastener positioned thereon, the plurality of loops operable to both receive a belt and to connect to a respective one of the plurality of pant leg fasteners;

wherein, when the first fastener of the plurality of loops are coupled to a respective one of the pant leg fasteners, the garment is at least partially folded and is operable to be worn as the skirt and, when the first fastener of the plurality of loops is detached from the respective one of the pant leg fasteners, the garment is unfolded and is operable to be worn as the pair of pants; and a piece of removable fabric and a connector configured to removably attach the piece of removable fabric to a corresponding connector attached to the inner side of the first tubular pant leg and the second tubular pant leg, wherein the piece of removable fabric is detachably attachable between the first tubular pant leg and the second tubular pant leg via the connector and the corresponding connector such that the removable fabric joins the first tubular pant leg and the second tubular pant leg to form a single piece of fabric without modification of the first tubular pant leg and the second tubular pant leg, wherein the formed single piece of fabric is configured to be worn at a hip region of a wearer as the skirt.

2. The garment of claim 1, wherein the pant leg fasteners comprises a first plurality of pant leg fasteners positioned on the first tubular pant leg, and a second plurality of pant leg fasteners positioned on the second tubular pant leg.

3. The garment of claim 2, wherein the first plurality of pant leg fasteners and the second plurality of pant leg fasteners positioned on the second tubular pant leg are positioned in a 2×3 matrix arrangement.

4. The garment of claim 1, wherein the plurality of loops are a plurality of belt loops extending upward from the waist region of the garment.

5. The garment of claim 1, wherein the connector is a zipper.

6. The garment of claim 1, wherein the plurality of first fasteners are female snap fasteners and the plurality of pant leg fasteners are male snap fasteners.

7. The garment of claim 1, wherein the plurality of pant leg fasteners are positioned in a shin region of the first tubular pant leg and the second tubular pant leg, respectively.

8. A garment convertible between a pair of pants and a skirt, comprising:

a waist region;

a pants region positioned below the waist region, the pants region comprising a first tubular pant leg and a second tubular pant leg, the first tubular pant leg and the second tubular pant leg each forming a closed tube with openings at an upper end and a lower end;

a plurality of pant leg fasteners positioned in the pants region at a bottom end of the garment on each of the first tubular pant leg and the second tubular pant leg;

a plurality of loops positioned on the waist region at a top end of the garment, individual ones of the plurality of loops comprising a first fastener positioned thereon, the plurality of loops operable to both receive a belt and to connect to a respective one of the plurality of pant leg fasteners;

wherein when the first fastener of the plurality of loops are coupled to a respective one of the pant leg fasteners, the garment is at least partially folded and is operable to be worn as the skirt and, when the first fastener of the plurality of loops is detached from the respective one of the pant leg fasteners, the garment is unfolded and is operable to be worn as the pair of pants; and a piece of removable fabric and a connector configured to removably attach the piece of removable fabric to a corresponding connector attached to the inner side of the first tubular pant leg and the second tubular pant leg, wherein the piece of removable fabric is detachably attachable between the first tubular pant leg and the second tubular pant leg via the connector and the corresponding connector such that the removable fabric joins the first tubular pant leg and the second tubular pant leg to form a single piece of fabric without modification of the first tubular pant leg and the second tubular pant leg, wherein the formed single piece of fabric is configured to be worn at a hip region of a wearer as the skirt;

coupling the piece of removable fabric to the first tubular pant leg and the second tubular pant leg and coupling the first fastener of the plurality of loops to a respective one of the pant leg fasteners and wearing the garment as the skirt; and detaching the first fastener of the plurality of loops from the respective one of the pant leg fasteners and detaching the piece of removable fabric from the first tubular pant leg and the second tubular pant leg and wearing the garment the pair of pants.

9. The method of claim 8, wherein the pant leg fasteners comprises a first plurality of pant leg fasteners positioned on the first tubular pant leg, and a second plurality of pant leg fasteners positioned on the second tubular pant leg.

10. The method of claim 9, wherein the first plurality of pant leg fasteners and the second plurality of pant leg fasteners positioned on the second tubular pant leg are positioned in a 2×3 matrix arrangement.

11. The method of claim 8, wherein the plurality of loops are a plurality of belt loops extending upward from the waist region of the garment.

12. The method of claim 8, wherein the connector is a zipper.

13. The method of claim 8, wherein the plurality of first fasteners are female snap fasteners and the plurality of pant leg fasteners are male snap fasteners.

14. The method of claim 8, wherein the plurality of pant leg fasteners are positioned in a shin region of the first pant leg and the second pant leg, respectively.

* * * * *